US006806431B2

(12) United States Patent
Kondoh et al.

(10) Patent No.: US 6,806,431 B2
(45) Date of Patent: Oct. 19, 2004

(54) LIQUID METAL MICRO-RELAY WITH SUSPENDED HEATERS AND MULTILAYER WIRING

(75) Inventors: You Kondoh, Yamato (JP); Tsutomu Takenaka, Hachioji (JP)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/627,308

(22) Filed: Jul. 25, 2003

(65) Prior Publication Data

US 2004/0159533 A1 Aug. 19, 2004

(30) Foreign Application Priority Data

Aug. 13, 2002 (JP) ..... 2002-236020

(51) Int. Cl.[7] ..... H01H 29/00
(52) U.S. Cl. ..... 200/182; 200/193
(58) Field of Search ..... 200/182, 199, 200/187–192, 214, 221, 222, 226–229

(56) References Cited

U.S. PATENT DOCUMENTS 6,323,447 B1 11/2001 Kondoh et al.
6,689,976 B1 * 2/2004 Dove et al. ..... 200/182
6,740,829 B1 * 5/2004 Wong ..... 200/214
6,743,991 B1 * 6/2004 Wong et al. ..... 200/182
6,750,413 B1 * 6/2004 Dove et al. ..... 200/182
6,756,551 B2 * 6/2004 Wong ..... 200/214
6,759,610 B1 * 7/2004 Dove et al. ..... 200/182
6,759,611 B1 * 7/2004 Wong et al. ..... 200/182
6,762,378 B1 * 7/2004 Wong ..... 200/182
6,765,161 B1 * 7/2004 Wong et al. ..... 200/182

FOREIGN PATENT DOCUMENTS

| | | | |
|---|---|---|---|
| EP | 1391903 | * | 8/2003 |
| JP | 9-161640 | | 6/1997 |
| WO | WO 00/41198 | | 7/2000 |
| WO | WO 01/46975 | | 6/2001 |

* cited by examiner

*Primary Examiner*—Michael Friedhofer
*Assistant Examiner*—Lisa Klaus

(57) ABSTRACT

A micro-relay device is provided including a fluid non-conductor. A first substrate and a second substrate are bonded together. A channel is defined in at least one of the substrates, and has a liquid metal in the channel. Electrodes are spaced along the channel and selectively interconnectable by the liquid metal. An open via is defined in one of the substrates and contains the fluid non-conductor. A heater substrate includes a suspended heater element in fluid communication with the open via. The suspended heater element is operable to cause the fluid non-conductor to separate the liquid metal.

20 Claims, 7 Drawing Sheets

LIQUID METAL MICRO-RELAY WITH SUSPENDED HEATERS AND MULTILAYER WIRING

BACKGROUND

1. Technical Field

The present invention relates to an electrical micro-relay device and more specifically to a liquid metal micro-relay device.

2. Background Art

There are many different types of electrical micro-relay devices, and one popular type is the reed micro-relay, which is a small, mechanical contact type of electrical micro-relay device. A reed micro-relay has two reeds made of a magnetic alloy sealed in an inert gas inside a glass vessel surrounded by an electromagnetic driver coil. When current is not flowing in the coil, the tips of the reeds are biased to break contact and the device is switched off. When current is flowing in the coil, the tips of the reeds attract each other to make contact and the device is switched on.

The reed micro-relay has problems related to large size and relatively short service life. As to the first problem, the reeds not only require a relatively large volume, but also do not perform well during high frequency switching due to their size and electromagnetic response. As to the second problem, the flexing of the reeds due to biasing and attraction causes mechanical fatigue, which can lead to breakage of the reeds after extended use.

In the past, the reeds were tipped with contacts composed of rhodium, tungsten, or were plated with rhodium or gold for conductivity and electrical arcing resistance when making and breaking contact between the reeds. However, these contacts would fail over time. This problem with the contacts has been improved with one type of reed micro-relay called a "wet" relay. In a wet relay, a liquid metal, such as mercury, is used to make the contact. This solves the problem of contact failure, but the problem of mechanical fatigue of the reeds remained unsolved.

In an effort to solve these problems, electrical micro-relay devices have been proposed that make use of the liquid metal in a channel between two micro-relay electrodes without the use of reeds. In the liquid metal devices, the liquid metal acts as the contact connecting the two micro-relay electrodes when the device is switched ON. The liquid metal is separated between the two micro-relay electrodes by a fluid non-conductor when the device is switched OFF. The fluid non-conductor is generally high purity nitrogen or other such inert gas.

With regard to the size problem, the liquid metal devices afford a reduction in the size of an electrical micro-relay device since reeds are not required. Also, the use of the liquid metal affords longer service life and higher reliability.

The liquid metal devices are generally manufactured by joining together two substrates with a heater in between to heat the gas. The gas expands to separate the liquid metal to open and close a circuit. Previously, the heaters were inline resistors patterned on one of the substrates between the two substrates. The substrates were of materials such as glass, quartz, and gallium arsenide upon which the heater material was deposited and etched. Since only isotropic etching could be used, the heater element would consist of surface wiring. The major drawback of surface wiring is that such wiring has poor high frequency characteristics, high connection resistance, and poor thermal transfer to the gas.

More recently, suspended heaters have been developed. A suspended heater refers to a configuration in which the heating elements are positioned so that they can be surrounded all the way around by the gas.

Generally, the suspended heaters are made by placing a heater material in a patterned shape on a sacrificial layer. The sacrificial layer is then etched away from under the heater material so that the heater material is suspended in space. The advantages of suspended heaters are that the gas heating efficiency is high and almost all of the heat that is generated by the heater is used to heat the gas because the surface area of the heater face that contacts the gas is large and the support areas are small. As a result, the transfer of heat to the support structure is minimized.

The preferred method for manufacturing a suspended heater is to place the heater material on a silicon substrate and then to etch the silicon substrate by anisotropic etching to undercut the heater material.

The problem with using silicon through out a micro-relay is that it is difficult to form multiple layer substrates with multiple layers of wiring.

On the other hand, ceramic materials can be formed to provide multiple layers of wiring and surface wiring does not have to be used. Contact electrodes can be formed with connecting vias. This permits a low connection resistance and favorable high frequency characteristics. Unfortunately, the formation of a suspended heater on a ceramic substrate is problematic and so the heater element must be formed on the surface of the ceramic substrate. With the heater formed on the surface of the ceramic substrate, a considerable portion of the heat generated by the heater is transferred directly to the substrate so that the gas heating efficiency decreases substantially. As a result, it is difficult to obtain rapid switching at low power.

Solutions to these problems have been long sought, but prior developments have not taught or suggested any solutions and, thus, solutions to these problems have long eluded those skilled in the art.

DISCLOSURE OF THE INVENTION

The present invention provides a micro-relay device including a fluid non-conductor. A first substrate and a second substrate are bonded together. A channel is defined in at least one of the substrates, and has a liquid metal in the channel. Electrodes are spaced along the channel and selectively interconnectable by the liquid metal. An open via is defined in one of the substrates and contains the fluid non-conductor. A heater substrate includes a suspended heater element in fluid communication with the open via. The suspended heater element is operable to cause the fluid nonconductor to separate the liquid metal. The micro-relay device provides rapid switching at low power in a small package.

Certain embodiments of the invention have other advantages in addition to or in place of those mentioned above.

The advantages will become apparent to those skilled in the art from a reading of the following detailed description when taken with reference to the accompanying drawings.

DETAILED DESCRIPTION OF THE INVENTION

Figure 1:
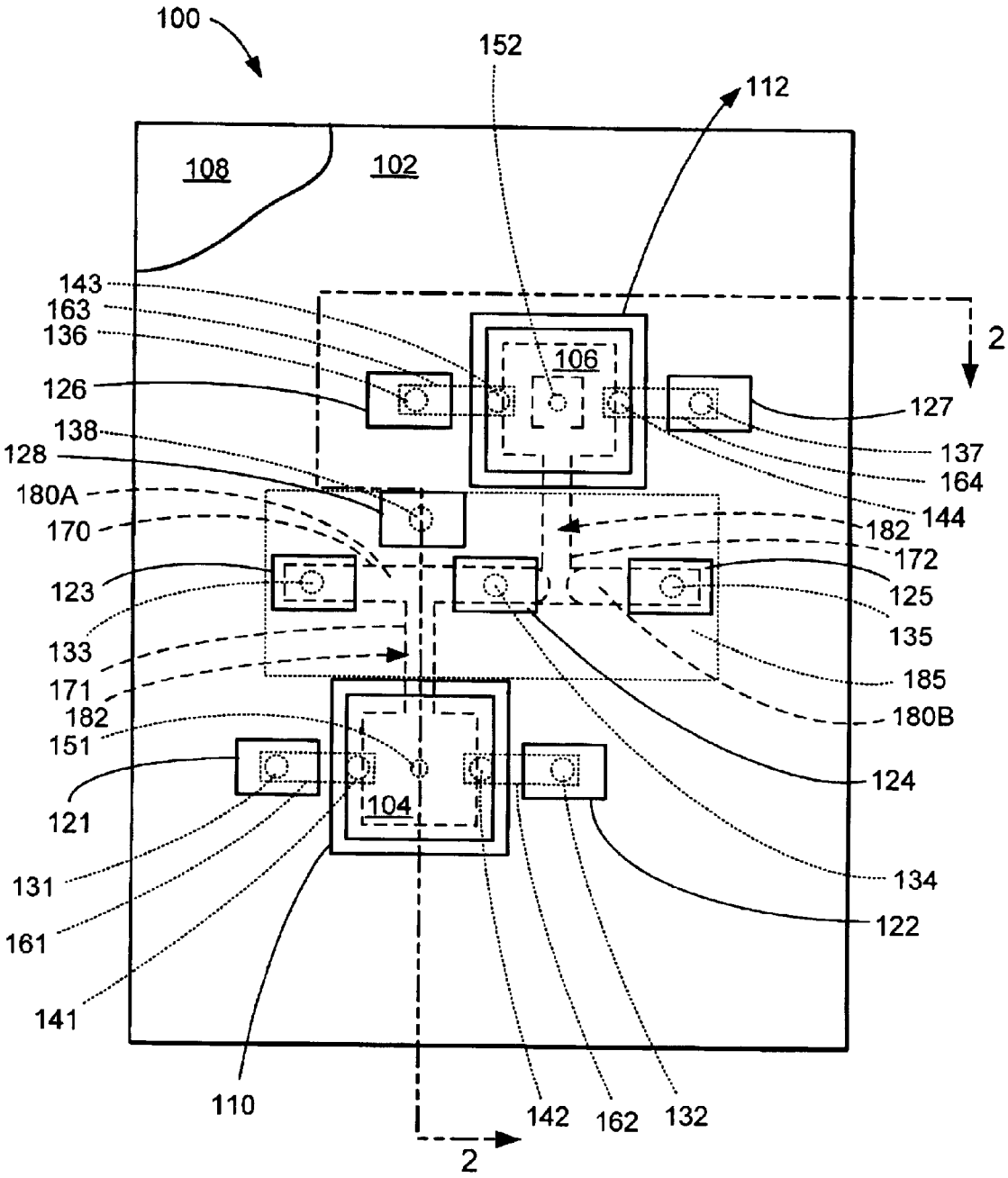
FIG. 1 is a bottom view of a liquid metal micro-relay in accordance with an embodiment of the present invention.
Figure 2:
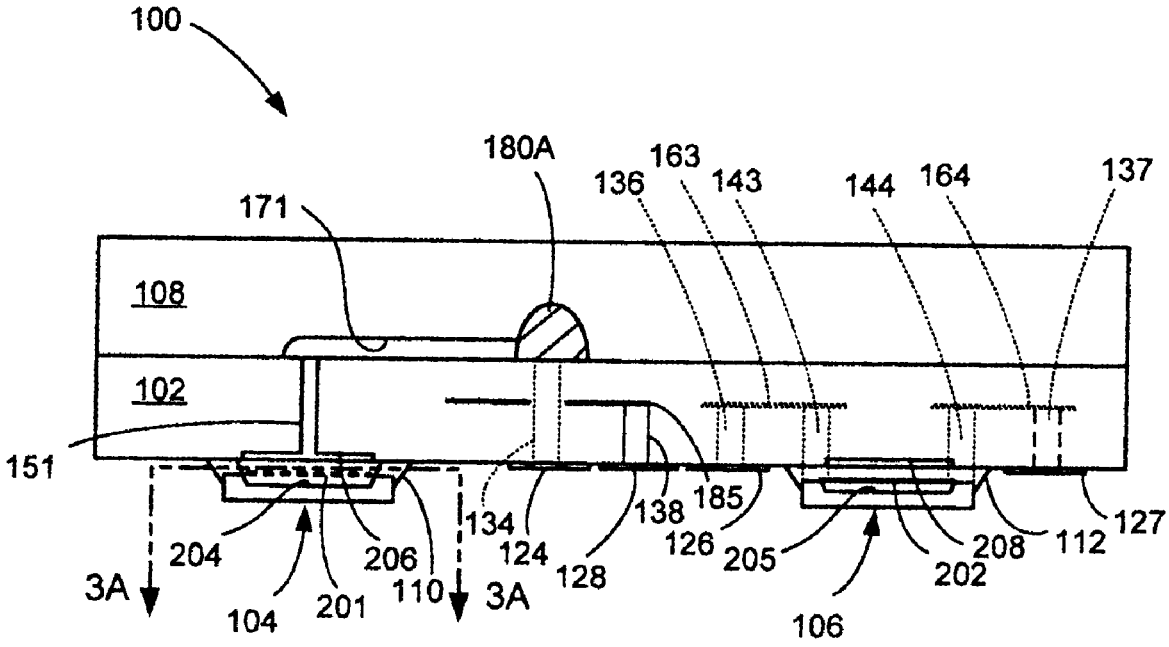
FIG. 2 is a cross-section of the structure of FIG. 1 taken along line 2—2.

Referring now to FIGS. 1 and 2, therein are shown a bottom view of a liquid metal micro-relay 100 and a cross-section of the structure of FIG. 1 taken along line 2—2, both in accordance with an embodiment of the present invention.

The liquid metal micro-relay 100 includes a bottom substrate 102 having heater substrates 104 and 106 bonded to its bottom surface by sealing resins 110 and 112, respectively. The sealing resins 110 and 112 may be a Teflon(R) type resin or an epoxy resin, which provide an airtight bond between the heater substrates 104 and 106 and the bottom substrate 102. The bottom substrate 102 is bonded in turn to a top substrate 108.

The term "horizontal" as used in herein is defined as a plane parallel to the major surface of a substrate, regardless of its orientation. Terms, such as "top", "bottom", "above", "below", "over", and "under" are defined with respect to the horizontal plane.

The bottom substrate 102 has a plurality of bonding pads 121 through 127 on its bottom horizontal surface for connection of electrical wires to the outside world. The bonding pads 121 through 128 are electrically conductive and connected to via conductors 131 through 138 in and extending at least partially through the bottom substrate 102. The via conductors 133, 134, and 135 form the contact electrodes for the liquid metal micro-relay 100. The via conductors 131 through 138 can be of standard conductor materials such as copper or aluminum, and via conductors 131, 132, and 136 through 138 may also be of a liquid metal since they are totally enclosed. Also, semiconductor device type vias of tungsten, tantalum, or titanium may also be formed.

The bottom substrate 102 further has via conductors 141 through 144, which also extend at least partially through the bottom substrate 102. Further, the bottom substrate 102 has a pair of open vias 151 and 152 in the area of the heater substrates 104 and 106, which extend through the bottom substrate 102.

Embedded in the bottom substrate 102 are conductors 161 through 164. The conductor 161 connects the via conductors 131 and 141, the conductor 162 connects the via conductors 132 and 142, the conductor 163 connects the via conductors 136 and 143, and the conductor 164 connects the via conductors 137 and 144.

The top substrate 108 contains a main channel 170 connected by subchannels 171 and 172 to the respective open vias 151 and 152 above the heater substrates 104 and 106. The main channel 170 contains a liquid metal, such as mercury (Hg), separated into two parts, liquid metal 180A and liquid metal 180B by a fluid non-conductor 182, such as high purity nitrogen or other such inert gas. The subchannels 171 and 172 are defined as being smaller than the main channel 170 so that the liquid metal does not enter the subchannels 171 and 172 but so that the fluid non-conductor 182 will. The subchannels 171 and 172 may also be formed in the bottom substrate 102.

A ground plane 185, which is optional, may be in any position that permits impedance matching for high frequency signal transmission through the liquid metal micro-relay 100. The ground plane 185 may be on the top substrate 108 or under the bottom substrate 102. It may be above the main channel 170 or two separate ground planes may be positioned above and below the main channel 170. The ground plane for purposes of illustration only is shown positioned in the bottom substrate 102 under the main channel 170. The ground plane 185 is connected by the via conductor 138 to the bonding pad 128.

Figure 3A:
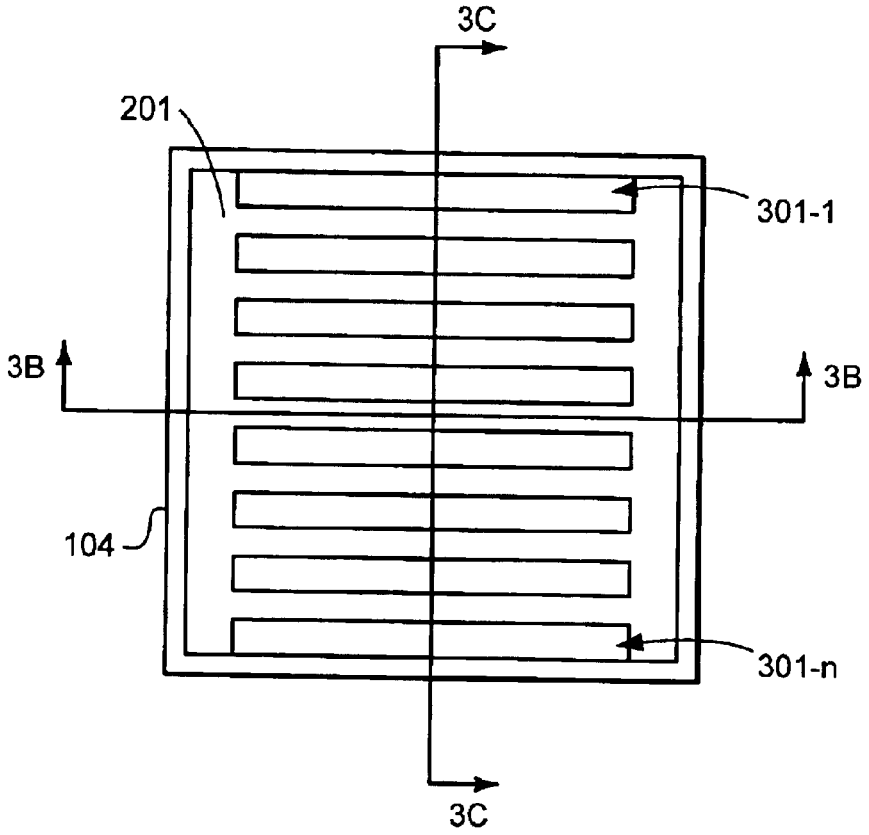
FIG. 3A is a cross-section of the structure of FIG. 2 taken along line 3A—3A.
Figure 3B:
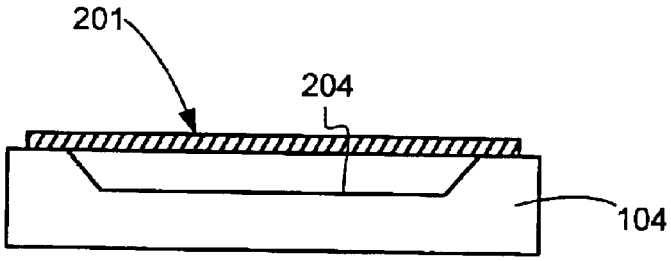
FIG. 3B is a cross-section of the structure of FIG. 3A taken along line 3B—3B.
Figure 3C:
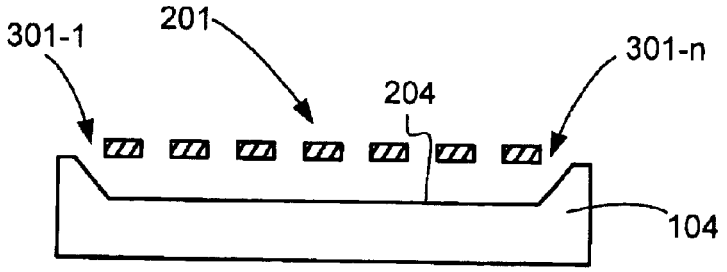
FIG. 3C is a cross-section of the structure of FIG. 3A taken along line 3C—3C.

Referring now to FIGS. 3A through 3C, it may be seen that the heater substrates 104 and 106 have suspended heater elements 201 and 202, respectively. In one embodiment, a polysilicon film with a thickness of 100 nm can be used as the suspended heater element; however, it is also possible to use a metal layer of a material such as platinum, nickel, or chrome as the heating element. In this latter case, it is necessary to coat the metal layer with a material, e.g., silicon oxide or silicon nitride, that does not react with the vapor of the liquid metal to avoid direct contact between the suspended heater element and the liquid metal.

The heater substrates 104 and 106 have respective undercuts 204 and 205, which separate the suspended heater elements 201 and 202 from the heater substrates 104 and 106. This undercut can be manufactured by accurately controlled anisotropic etching, which allows for accurate regulation of the volume of the fluid non-conductor 182 surrounding the suspended heater elements 201 and 202.

The suspended heater elements 201 and 202 are further spaced away from the bottom substrate 102 and oriented by protrusions of the via conductors, as exemplified by the via conductors 143 and 144, which extend from the bottom substrate 102 to separate the heater substrate 104 from the bottom substrate 102. The heater substrate 106 is then held in place by the sealing resin 112. To further precisely size the volume of the fluid non-conductor 182 all around the suspended heater elements 201 and 202, the bottom substrate 102 is provided with reliefs 206 and 208 around the open vias 151 and 152.

In the present invention, the different substrates may be manufactured out of different materials such as silicon, glass, ceramic, or combinations thereof. The bottom substrate 102 of FIG. 2 is one example of a finished multilayer structure.

In manufacturing substrates out of ceramic and glass, unfired materials, i.e., "green" or "raw" ceramics and glasses, are processed to make multilayer structures, which are machined and then fired. These materials have been used because of their mechanical integrity and ability to be incorporated with electrical circuitry. In some cases, they were used because of high temperature resistance, good high frequency signal characteristics, or good thermal coefficient properties.

The multilayer ceramic manufacturing process consists of forming a slurry of ceramic and glass powders combined with thermoplastic organic binders and high pressure solvents. The slurry is doctor-bladed onto a carrier. After volatilization of the high vapor pressure solvents and removal from the carrier, a green ceramic tape is formed. The green ceramic tape generally has sufficient rigidity that it is self-supporting.

A mechanical or laser operation may be used to form via holes, channels, recesses, or other structures in the green ceramic tape. Green ceramic is used at this point because it is softer than fired ceramic and thus easier to process by normal manufacturing tools for high volume manufacturing.

For example, vias can easily be drilled, punched, or otherwise formed in the green ceramic tape. Similarly, other processes such as grinding and laser ablation are easily performed on the green ceramic tape to form channels or ducts. Various types of laser ablation can be used for patterning, such excimer lasing and YAG lasing. Using a laser allows fine structures to be formed but require more time.

Thick-film printing techniques can be used to lay down conductor material on the green ceramic tape in the form of a fusible metal paste. The fusible metal paste can also fill the vias and channels or ducts to form conductor structures. These conductor structures allow the connection resistance to be low and permit impedance matching for high frequency signal transmission.

A number of green ceramic tapes are placed on top of each other and aligned in multiple layers. Open vias extending through one or more layers can be provided with inserts to transmit the lamination force through unsupported regions from the top tape to the bottom tape.

The green ceramic tapes are then compressed and fired.

During the compression, the thermoplastic component (e.g., polyvinyl butyral) within the green layers flows and results in mutual adhesion of the green layers and conformation of the green layers around the pattern of metal paste. In addition to binding the individual green layers into a coherent green laminate structure, the lamination operation determines the density of the green laminate structure and thus the shrinkage during firing and the dimensional accuracy of the fired laminate structure. The green lamination should have a uniform density to prevent differential shrinkage during firing.

A high temperature firing of the green laminate results in a volatilization of the organic components and sintering of the coherent green laminate structure into a monolithic ceramic. At the same time, the fusible metal paste fuses into an electrically and mechanically connected conductors, electrodes, and pads.

By way of example, the lamination operation can impose a compressive stress of the order of 500 psi to 2,000 psi on the green laminate structure and the firing can be performed at an elevated temperature of approximately 75° C.

In operation, by reference to FIG. 1, by applying a current across the bonding pads 121 and 122, the heating element 201 of FIG. 2 is heated causing the gas above the heater substrate 102 to expand and move through the via 151 and the subchannel 171 to cause the liquid metal 180A to separate with a center portion joining with the liquid metal 180B. This opens the conductive connection between the bonding pad 123 and the bonding pad 124, and closes the conductive connection between the bonding pad 124 and the bonding pad 125.

Conversely, applying a current across the bonding pads 126 and 127 heats the heating element 202 of FIG. 2 and causes the liquid metal 180B to be separated to return the liquid metal micro-relay 100 to the position shown in FIG. 1.

Referring now to FIG. 3A, therein is shown a structure of FIG. 2 along line 3A—3A. The heater substrate 104 is shown with the suspended heater element 201 positioned above it. It may be seen that the suspended heater element 201 has a plurality of openings 301-1 through 301-N.

Referring now to FIG. 3B, therein is shown the structure of FIG. 3A taken along the line 3B—3B. The heater substrate 104 has the suspended heater element 201 positioned above it and the heater substrate 104 has the undercut 204 so that the suspended heater element 201 is suspended in space.

Referring now to FIG. 3C, therein is shown the structure of FIG. 3A taken along line 3C—3C. The cross-section shows the openings 301-1 through 301-N which would permit free flow of gases around the suspended heater element 201.

Figure 4:
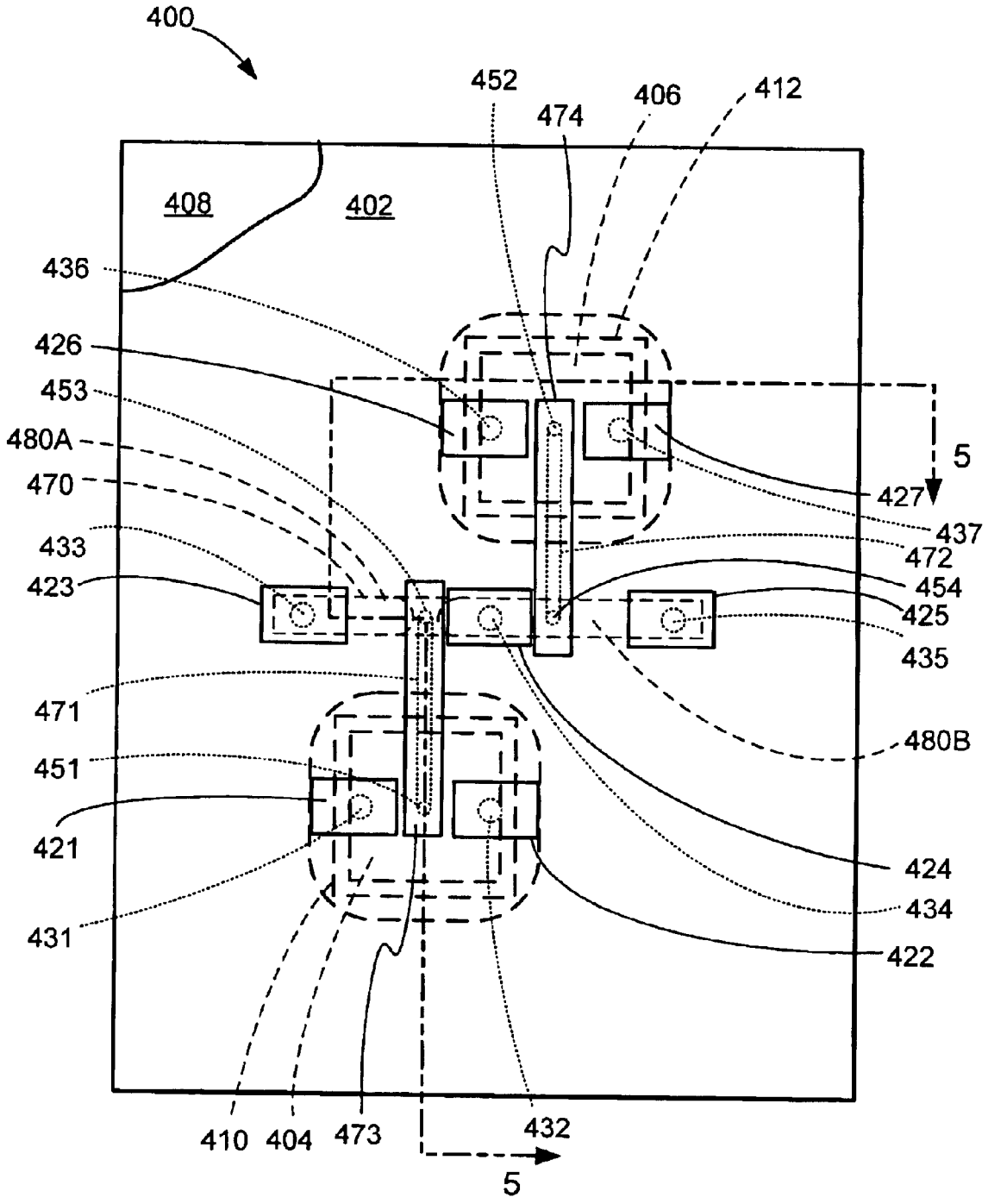
FIG. 4 is a bottom view of a liquid metal micro-relay in accordance with a further embodiment of the present invention.
Figure 5:
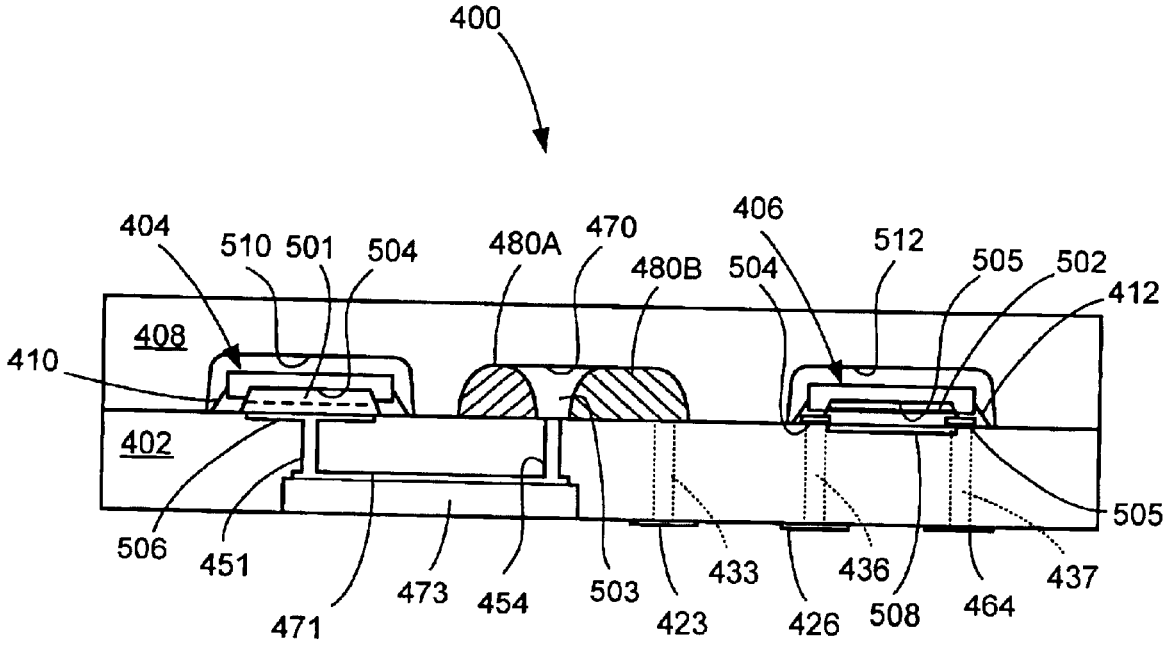
FIG. 5 is a cross-section of the structure of FIG. 4 taken along line 5—5.

Referring now to FIGS. 4 and 5, therein are shown a bottom view of a liquid metal micro-relay 400 and a cross-section of the structure of FIG. 4 taken along line 5—5, both in accordance with a further embodiment of the present invention.

The liquid metal micro-relay 400 includes a bottom substrate 402 having heater substrates 404 and 406 bonded to its top surface by sealing resins 410 and 412, respectively. The sealing resins 410 and 412 may be a Teflon$^{(R)}$ type resin or an epoxy resin between the heater substrates 404 and 406 and the bottom substrate 402. The bottom substrate 402 is bonded in turn to a top substrate 408.

The bottom substrate 402 has a plurality of bonding pads 421 through 427 on its bottom horizontal surface for connection of electrical wires to the outside world. The bonding pads 421 through 427 are electrically conductive and connected to via conductors 431 through 437 in and extending at least partially through the bottom substrate 402. The via conductors 433, 434, and 435 form contact electrodes for the liquid metal micro-relay 400.

Further, the bottom substrate 402 has open vias 451 and 452 under the heater substrates 404 and 406 and open vias 453 and 454 under a main channel 470. The open vias 451 and 453 are connected at the bottom by a subchannel 471 and the open vias 452 and 454 are connected at the bottom by a subchannel 472. The subchannel 471 is covered at the bottom by a sealing plug 473 and the subchannel 472 is covered at the bottom by a sealing plug 474. This structure is easily achievable through the use of a ceramic multilayer structure as described above.

The top substrate 408 contains a main channel 470 connected by the subchannels 471 and 472 to respective open vias 451 and 452. The main channel 470 contains a liquid metal, such as mercury (Hg), separated into two parts, liquid metal 480A and liquid metal 480B.

In FIG. 5, it may be seen that the heater substrates 404 and 406 have suspended heater elements 501 and 502, respectively. The heater substrates 404 and 406 have respective undercuts 504 and 505, which separate the suspended heater elements 501 and 502 from the heater substrates 404 and 406, respectively. The suspended heater elements 501 and 502 are further spaced away from the bottom substrate 402 by conductor pads, as exemplified by conductor pads 504 and 505 on the via conductors, as exemplified by the via conductors 436 and 437, to separate the heater substrate 406, which is then held in place by the sealing resin 412. To further precisely size the volume of the fluid non-conductor 503 around the suspended heater elements 501 and 502, the bottom substrate 402 is provided with reliefs 506 and 508.

The heater substrates 404 and 406 are respectively disposed in cavities 510 and 512 in the top substrate 408. Since the top substrate 408 is bonded to the bottom substrate 402 by an airtight seal, the sealing resins 410 and 412 do not necessarily have to be airtight.

In operation, by reference to FIG. 4, by applying a current across the bonding pads 421 and 422, the suspended heating element 501 of FIG. 5 is heated causing the gas above the heater substrate 404 to expand and move through the via 451 and the subchannel 471 to cause the liquid metal 480A to separate with a center portion joining with the liquid metal 480B. This opens the conductive connection between the bonding pad 423 and the bonding pad 424, and closing the conductive connection between the bonding pad 424 and the bonding pad 425.

Conversely, applying a current across the bonding pads 426 and 427 heats the suspended heating element 502 of FIG. 2 and causes the liquid metal 480B to be separated to return the liquid metal micro-relay 400 to the position shown in FIG. 4.

Figure 6:
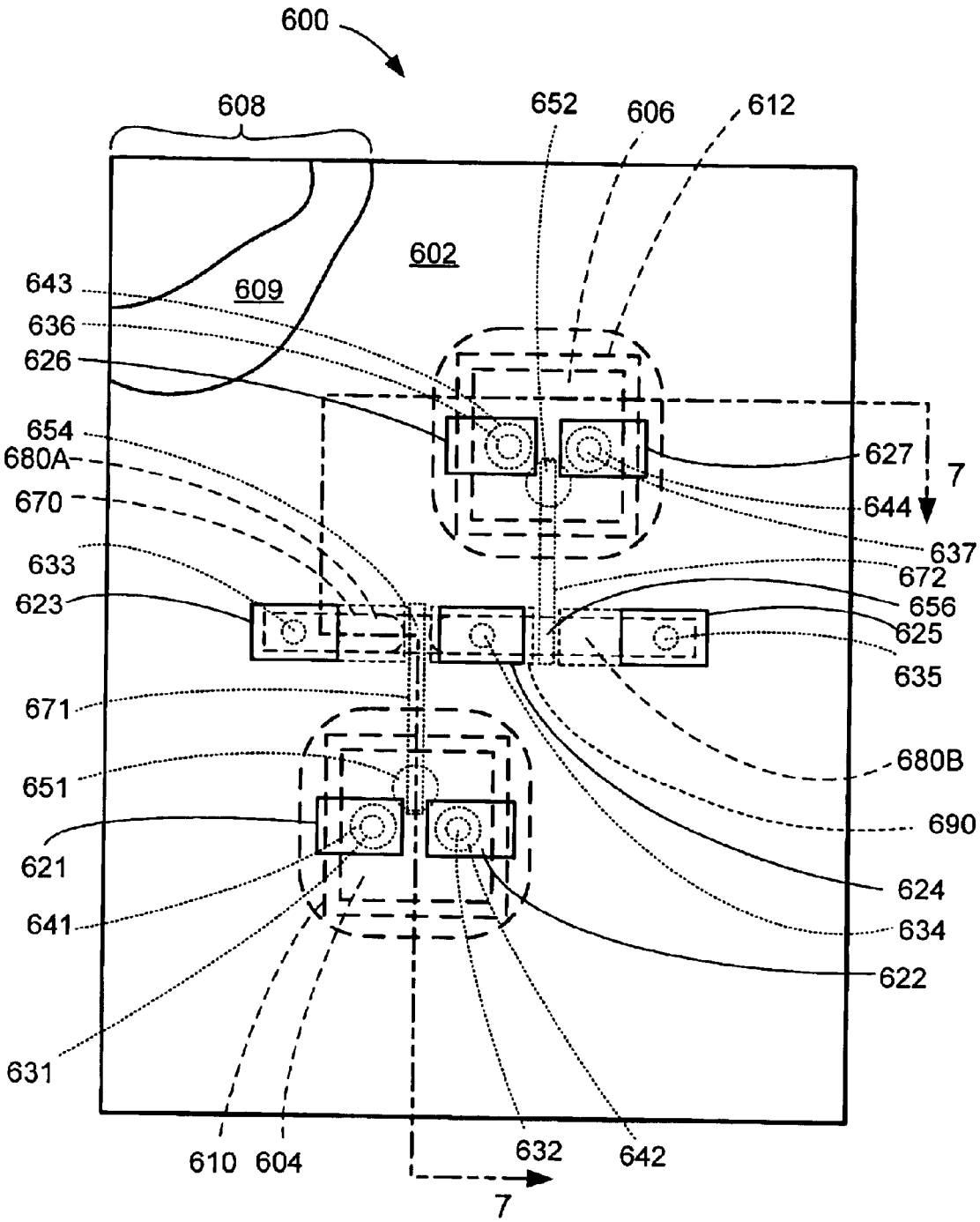
FIG. 6 is a bottom view of a liquid metal micro-relay in accordance with a still further embodiment of the present invention.
Figure 7:
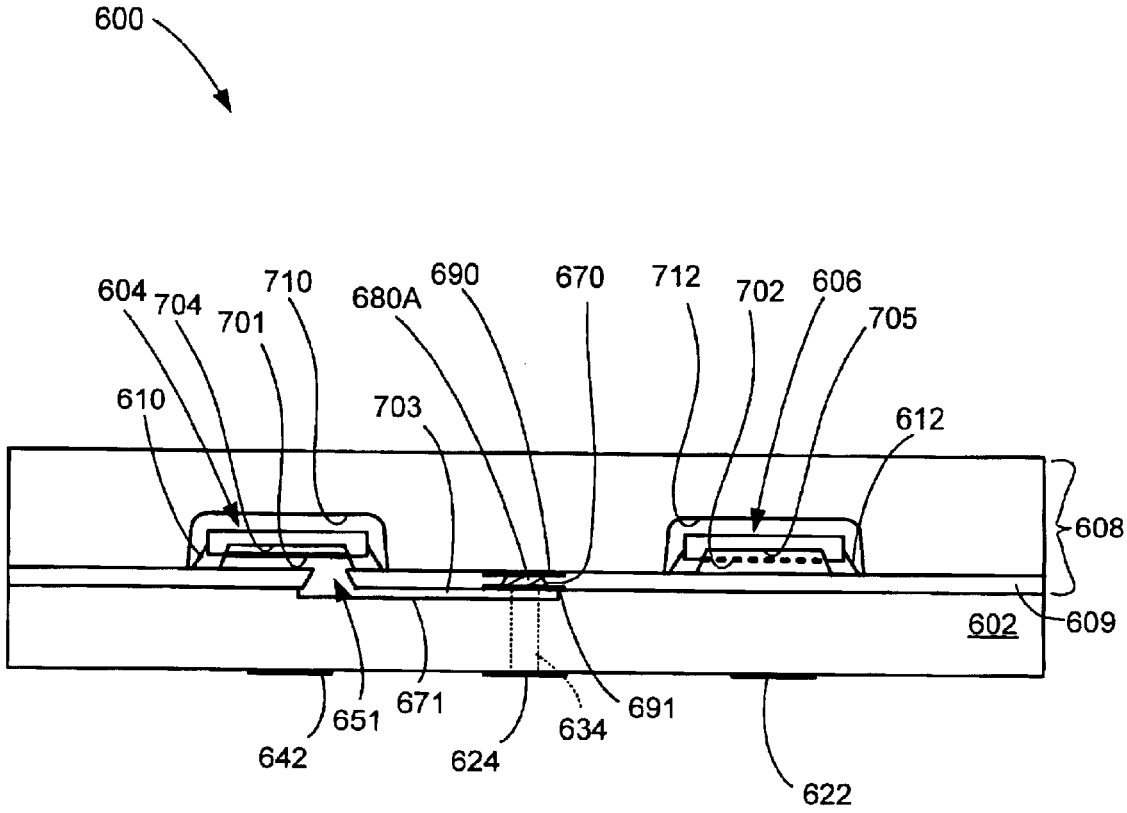
FIG. 7 is a cross-section of the structure of FIG. 6 taken along line 7—7.

Referring now to FIGS. 6 and 7, therein are shown a bottom view of a liquid metal micro-relay 600 and a cross-section of the structure of FIG. 6 taken along line 7—7, both in accordance with a still further embodiment of the present invention.

The liquid metal micro-relay 600 includes a bottom substrate 602 and a top substrate 608. The top substrate 608 may be glass and includes a lower layer 609 having heater substrates 604 and 606 bonded to its top surface by sealing resins 610 and 612, respectively. The sealing resins 610 and 612 may be a Teflon(R) type resin or an epoxy resin. The bottom substrate 602 is bonded to the lower layer 609 of the top substrate 608.

The bottom substrate 602 has a plurality of bonding pads 621 through 627 on its bottom surface. The bonding pads 621 through 627 are electrically conductive and connected to via conductors 631 through 637 in and extending at least partially through the bottom substrate 602. The via conductors 633, 634, and 635 form contact electrodes for the liquid metal micro-relay 600. The via conductors 631, 632, 636, and 637 are respectively connected to countersunk regions 641, 642, 643, and 644 in the lower layer 609.

Further, the lower layer 609 has countersunk regions, which form open vias 651 and 652 in the area of the heater substrates 604 and 606. The lower layer 609 also contains a main channel 670. The main channel 670 contains a liquid metal, such as mercury (Hg), separated into two parts, liquid metal 680A and liquid metal 680B. The main channel may also have top and bottom plating 690 and 691 (only the top plating 690 is shown).

The bottom substrate 602 contains a pair of trenches, which form subchannels 671 and 672 from the open vias 651 and 652, respectively, below the heater substrates 604 and 606 to the main channel 670.

In FIG. 7, it may be seen that the heater substrates 604 and 606 have attached suspended heater elements 701 and 702, respectively. The heater substrates 604 and 606 have respective undercuts 704 and 705, which cause the suspended heater elements 701 and 702 to be suspended away from the heater substrates 604 and 606. The suspended heater elements 701 and 702 are further spaced away from the bottom substrate 602 by the sealing resins 610 and 612.

The heater substrates 604 and 606 are respectively disposed in cavities 710 and 712 in the top substrate 608. Since the lower layer 609 of the top substrate 608 is bonded to the bottom substrate 602 by an airtight seal, the sealing resins 610 and 612 do not necessarily have to be airtight.

The open bottom portion of the heater substrates 604 and 606 are open to the open vias 651 and 652 (with only the open via 651 shown) and connected by the subchannels 671 and 672 (with only the subchannel 671 shown) to the main channel 670. The main channel 670 is shown with top and bottom plating 690 and 691, respectively, adjacent the via conductors 633, 634, and 635. The top and bottom plating 690 and 691 are of metals with sufficient wetability to allow the liquid metal to conform to the shape of the main channel 670. This prevents leakage of a fluid non-conductor 703 around the liquid metal so that the expansion force is transmitted to the liquid metal with high efficiency, and thus increases the reliability of the movement of the liquid metal so that the reliability of the switching operation can be increased.

In operation, by reference to FIG. 6, by applying a current across the bonding pads 621 and 622, the suspended heating element 701 of FIG. 7 is heated causing the fluid non-conductor 703 above the heater substrate 602 to expand and move through the via 651 and the subchannel 671 to cause the liquid metal 680A to separate with the center section joining with liquid metal 680B. This opens the conductive connection between the bonding pad 623 and the bonding pad 624, and closes the conductive connection between the bonding pad 624 and the bonding pad 625.

Conversely, applying a current across the bonding pads 626 and 627 heats the suspended beating element 702 of FIG. 2 and causes the liquid metal 680B to be separated to return the liquid metal micro-relay 600 to the position shown in FIG. 6.

The present invention has been described with reference to examples in which the channel is provided or defined in the top substrate. However, the channel can alternatively be defined in the bottom substrate or in both the top and the bottom substrates. The via conductors, the open vias, conductors, electrodes, subchannels, and ground planes may similarly be formed or defined in the top and/or bottom substrates. Micro-relays in accordance with the present invention can be oriented differently from the examples shown.

While the invention has been described in conjunction with specific embodiments, it is to be understood that many alternatives, modifications, and variations will be apparent to those skilled in the art in light of the foregoing description. Accordingly, it is intended to embrace all such alternatives, modifications, and variations that fall within the scope of the included claims. All matters hithertofore set forth or shown in the accompanying drawings are to be interpreted in an illustrative and non-limiting sense.

The invention claimed is:

1. A micro-relay device, comprising:

a fluid non-conductor;

a first substrate and a second substrate bonded together;

a channel defined in at least one of the substrates;

liquid metal in the channel;

electrodes spaced along the channel and selectively interconnectable by the liquid metal;

an open via defined in one of the substrates and containing the fluid non-conductor; and a heater substrate comprising a suspended heater element in fluid communication with the open via, the suspended heater element operable to cause the fluid non-conductor to separate the liquid metal.

2. The micro-relay device of claim 1, wherein:

the first substrate comprises at least one substrate layer and at least one of a connecting via, the open via, a conductor, an electrode, a subchannel, and a ground plane.

3. The micro-relay device of claim 1, additionally comprising:

a subchannel defined in at least one of the substrates, the subchannel extending between the channel and the open via.

4. The micro-relay device of claim 1, wherein:

the first substrate comprises a remote surface remote from the second substrate; and the heater substrate is bonded to the remote surface of the first substrate.

5. The micro-relay device of claim 1, wherein:

the second substrate comprises an adjacent surface adjacent the first substrate; and the heater substrate is bonded to the adjacent surface of the second substrate.

6. The micro-relay device of claim 1, wherein:

the second substrate is a multilayer substrate comprising an adjacent layer adjacent the first substrate; and the heater substrate is bonded to the adjacent layer of the second substrate.

7. The micro-relay device of claim 1, wherein:

the second substrate is a multilayer substrate comprising an adjacent layer adjacent the first substrate, the adjacent layer comprising a remote surface remote from the first substrate;

the adjacent layer of the second substrate comprises conductors and the open vias are defined therein; and the heater substrate is bonded to the remote surface of the adjacent layer.

8. The micro-relay device of claim 1, wherein:

the first substrate, the second substrate, and the heater substrate each comprise at least one of silicon, glass and ceramic.

9. The micro-relay device of claim 1, wherein:

the suspended heater element comprises at least one of polysilicon, platinum, nickel and chromium.

10. The micro-relay device of claim 1, wherein:

at least one of the substrates comprises a conductive plane adjacent the channel.

11. A micro-relay device, comprising:

a non-conductor gas;

a first substrate and a second substrate bonded together;

a channel defined in at least one of the substrates;

liquid mercury in the channel;

first, second, and third electrodes spaced along the channel and connectible by the liquid mercury;

first and second open vias defined in at least one of the substrates in fluid communication with the channel, the open vias containing the non-conductor gas; and first and second heater substrates each comprising a respective suspended heater element, the first and second heater substrates in fluid communication with the first and second open vias, respectively, and operable to selectively cause the non-conductor gas to separate the liquid mercury between the first and second electrodes and the second and third electrodes, respectively.

12. The micro-relay device of claim 11, wherein:

the first substrate comprises at least one layer and at least one structure selected from a conductor, the open vias, the first, second, and third electrodes, a subchannel, and a ground plane.

13. The micro-relay device of claim 11, additionally comprising:

first and second subchannels defined in at least one of the substrates, the first and second subchannels respectively connecting the first and second heater substrates with the channel.

14. The micro-relay device of claim 11, wherein:

the first substrate comprises a remote surface remote from the second substrate;

the first and second heater substrates are bonded to the remote surface of the first substrate; and the micro-relay device additionally comprises bonding pads on the remote surface of the first substrate and conductors extending between the first and second suspended heater elements and the bonding pads.

15. The micro-relay device of claim 11, wherein:

the first substrate comprises an adjacent surface adjacent the second substrate;

the first and second heater substrates are bonded to the adjacent surface of the first substrate; and the micro-relay device additionally comprises bonding pads on the adjacent surface of the first substrate and conductors extending between the first and second suspended heater elements and the bonding pads.

16. The micro-relay device of claim 11, wherein:

the first substrate comprises a remote surface remote from the second substrate;

the second substrate is a multilayer substrate comprising an adjacent layer adjacent the first substrate;

the adjacent layer comprises an adjacent surface adjacent the first substrate and a remote surface remote from the first substrate;

the first and second heater substrates are bonded to the remote surface of the adjacent layer;

the channel and the open vias are defined in the adjacent layer and the first, second and third electrodes are on the adjacent surface of the adjacent layer; and the micro-relay device additionally comprises first and second subchannels defined in the first substrate, bonding pads located on the remote surface of the first substrate, and conductors extending through the first substrate between the first and second suspended heater elements and the bonding pads.

17. The micro-relay device of claim 11, wherein:

the first substrate comprises a remote surface remote from the second substrate; and the micro-relay device additionally comprises:

adjacent the channel, a ground plane impedance matched to a high frequency signal through the mercury, and a bonding pad on the remote surface the first substrate, and further conductors extending between the ground plane and the bonding pad.

18. The micro-relay device of claim 11, wherein:

the first substrate, the second substrate, and the heater substrate each comprise at least one of silicon, glass and ceramic; and the first substrate, the second substrate, and the heater substrate are of different materials.

19. The micro-relay device of claim 11, wherein:

the first and second suspended heater elements each comprise at least one of polysilicon, platinum, nickel and chromium; and the first and second heater substrates comprise silicon and define respective undercuts.

20. The micro-relay device of claim 11, wherein:

the second substrate comprises a conductive plane adjacent the first, second, and third electrodes and separated therefrom.

* * * * *